US008051592B2

(12) United States Patent
Chang

(10) Patent No.: US 8,051,592 B2
(45) Date of Patent: Nov. 8, 2011

(54) ROTATABLE GRAPHIC ASSEMBLY

(75) Inventor: Chin-Ming Chang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 218 days.

(21) Appl. No.: 12/604,348

(22) Filed: Oct. 22, 2009

(65) Prior Publication Data

US 2011/0023337 A1 Feb. 3, 2011

(30) Foreign Application Priority Data

Aug. 3, 2009 (CN) ..... 2009 1 0305131

(51) Int. Cl.
*G09F 3/18* (2006.01)

(52) U.S. Cl. ..... 40/661.11; 40/493; 361/679.01; 361/679.02; 403/325

(58) Field of Classification Search ..... 403/348, 403/325; 40/493, 661.11; 16/329, 341, 344
See application file for complete search history.

(56) References Cited

U.S. PATENT DOCUMENTS 6,477,799 B1 * 11/2002 Erickson et al. ..... 40/406
7,365,968 B2 * 4/2008 Chen et al. ..... 361/679.27
2005/0157455 A1 * 7/2005 Hernandez et al. ..... 361/681
* cited by examiner

*Primary Examiner* — Joanne Silbermann
*Assistant Examiner* — Kristina Staley
(74) *Attorney, Agent, or Firm* — Altis Law Group, Inc.

(57) ABSTRACT

A rotatable graphic assembly includes an outer barrel including an inner surface and a plurality of inner teeth formed thereon with an inner bevel formed at an end of each inner tooth; an inner barrel received within the outer barrel, the inner barrel including an outer surface and a plurality of outer teeth formed on the outer surface with an outer bevel formed at an end of each outer tooth and movably engaged with the inner teeth, the inner barrel defining a first crown gear portion at one end thereof; a spring sleeved in the inner barrel; a base sealing one end of the outer barrel, and the spring biased between the other end of the outer barrel away from the base and the base; and the base defines a second crown gear facing the first crown gear portion; and a button disposed on the end of the second barrel away from the base and showing a graphic.

8 Claims, 4 Drawing Sheets

ROTATABLE GRAPHIC ASSEMBLY

BACKGROUND

1. Technical Field

The present disclosure relates to a graphic assembly and, particularly, to a rotatable graphic assembly that can accommodate varying orientations.

2. Description of Related Art

It is not uncommon, in order to save space or for other purposes, to re-orient a desktop computer or a similar device from a vertical configuration to a horizontal configuration. As such, a graphic, such as a maker's logo, displayed on the exterior of the computer is also changed to an unfavorable orientation.

Therefore, a rotatable graphic assembly to overcome the described limitations is desirable.

DETAILED DESCRIPTION

Embodiments of the present rotatable graphic assembly will now be described in detail with reference to the drawings.

Figure 1:
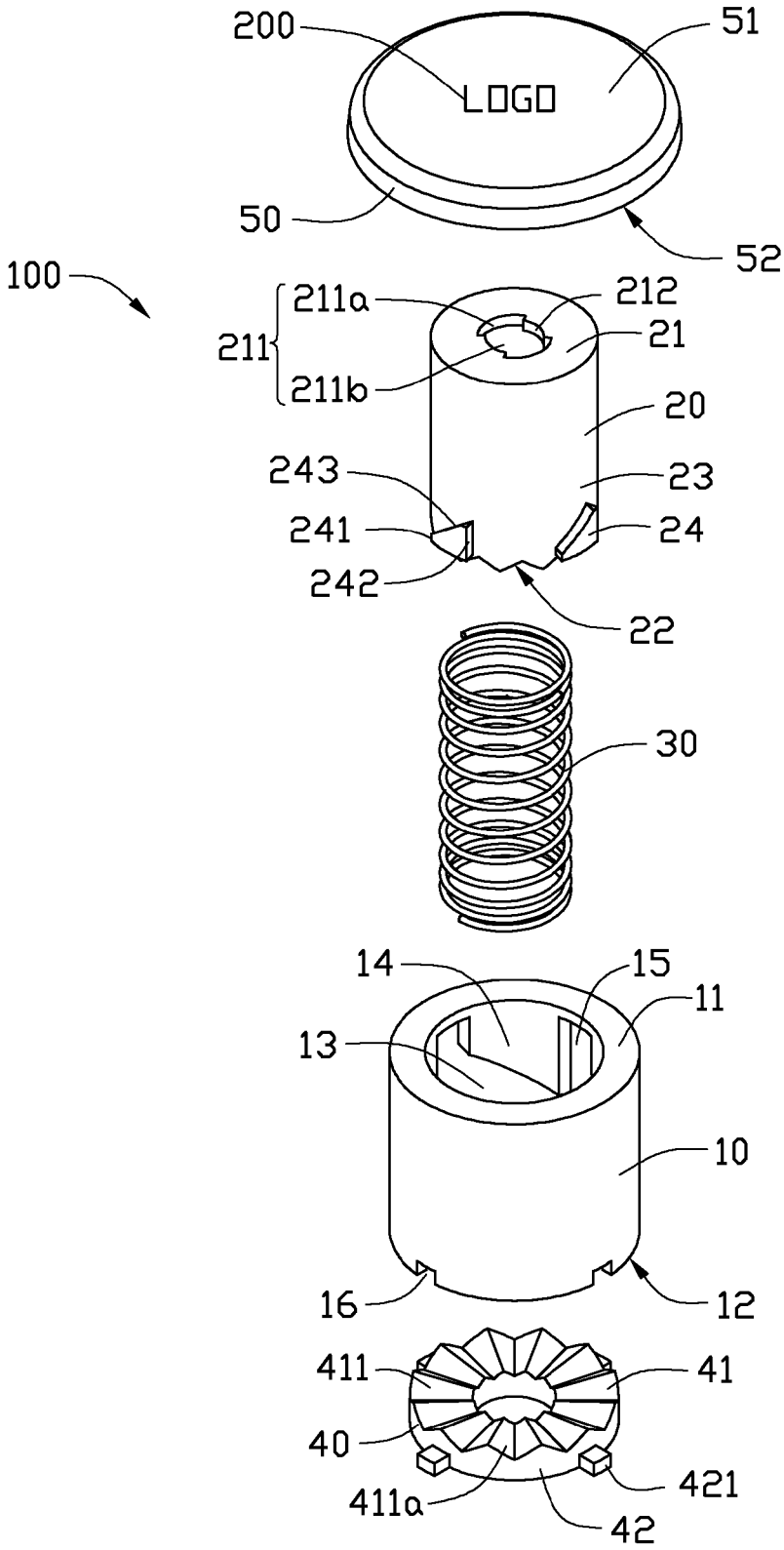
FIG. 1 is an isometric and exploded view of a rotatable graphic assembly, according to an exemplary embodiment.
Figure 2:
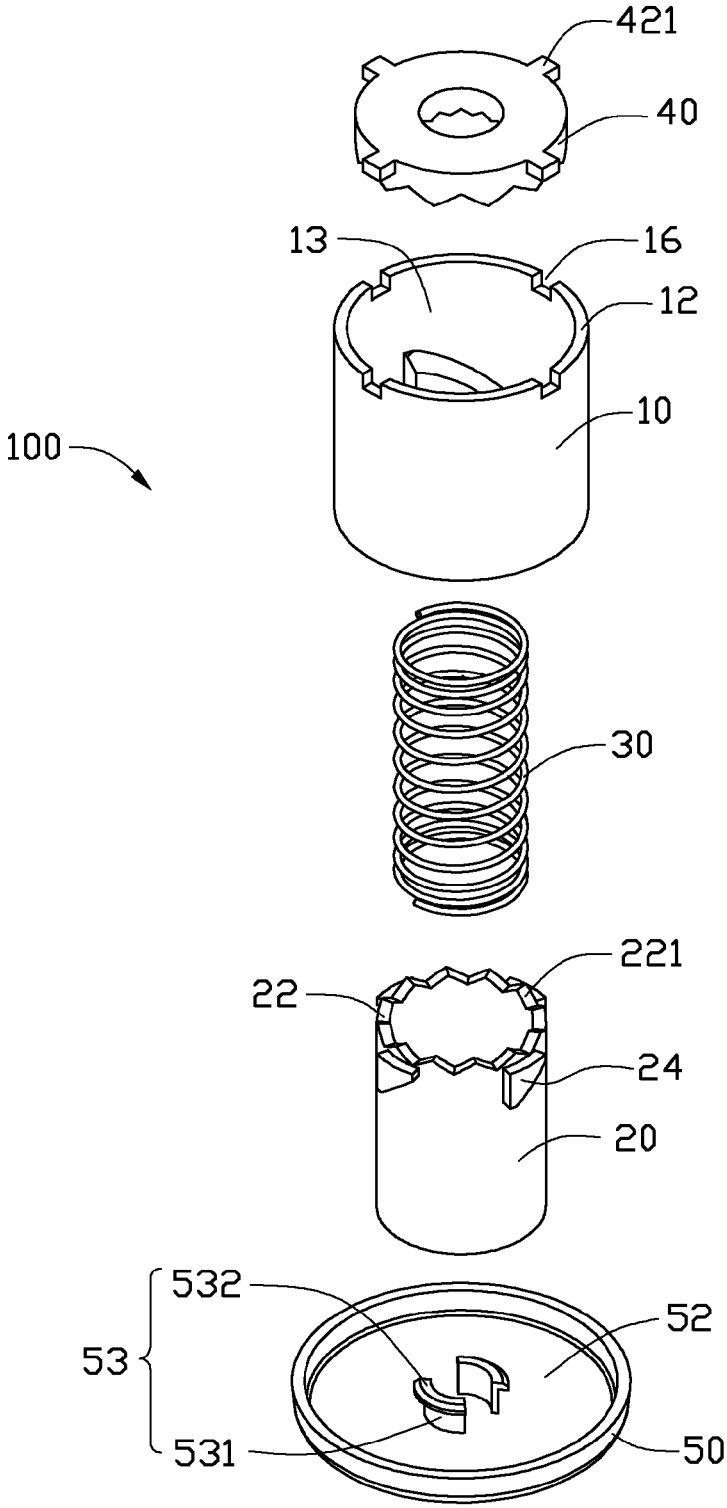
FIG. 2 is an isometric and exploded view of the rotatable graphic assembly of FIG. 1, viewed from another angle.
Figure 3:
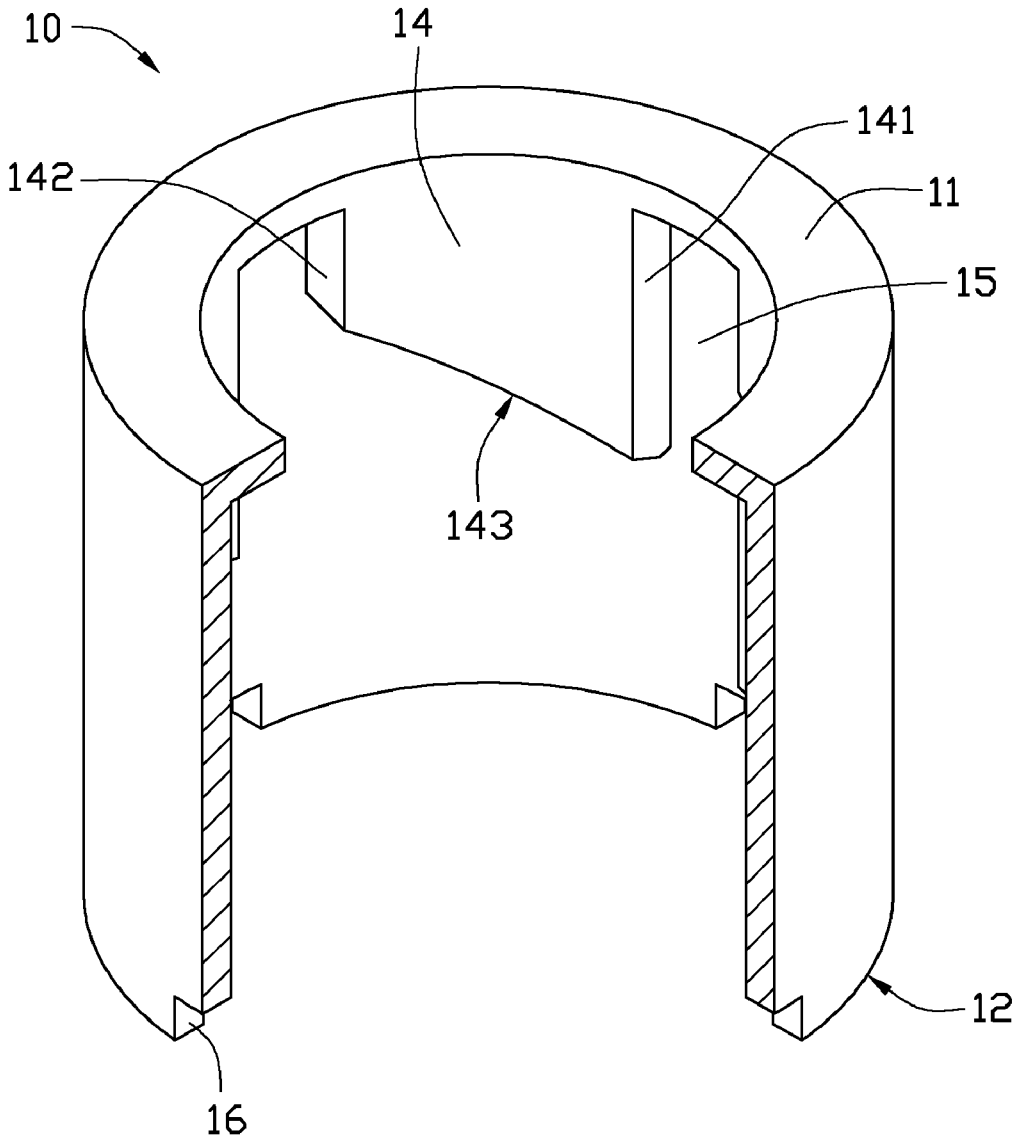
FIG. 3 is a cutaway view of an outer barrel of the rotatable graphic assembly of FIG. 1.

Referring to FIGS. 1-3, a rotatable graphic assembly 100, according to an exemplary embodiment, includes an outer barrel 10, an inner barrel 20, a spring 30, a base 40, and a button 50.

The outer barrel 10 includes a first upper surface 11 interconnected by an inner surface 13 to a first lower surface 12. The outer barrel 10 includes four spaced inner teeth 14 uniformly arranged around the circumference of the inner surface 13. The inner teeth 14 are generally bent trapezoids projecting from the first upper surface 11, with each including a first inner side 141, a second inner side 142, and an inner bevel 143. The first inner side 141 and the second inner side 142 are generally parallel to the central axis of the outer barrel 10, and the first inner side 141 is longer than the second inner side 142. The inner bevel 143 interconnects the first inner side 141 and the second inner side 142 facing away from the first upper surface 11. The first inner side 141 of one inner tooth 14 faces the second side 142 of an adjacent inner tooth 14, thereby forming a guiding slot 15 therebetween. However, each two adjacent inner teeth 14 are bridged at one end adjacent to the first upper surface 11. As such, one end of the guiding slot 15 adjacent to the first upper surface 11 is blocked. The outer barrel 10 defines four uniformly distanced fixing grooves 16 around the annular first lower surface 12.

The inner barrel 20 includes a second upper surface 21 interconnected by an outer surface 23 to a second lower surface 22. The outer diameter of the inner barrel 20 is less than the inner diameter of the outer barrel 10. The inner barrel 20 defines a latching hole 211 generally in the center of the second upper surface 21. Two curved baffles 212 extend inwards from two opposite portions of the sidewall of the latching hole 211. As such, the baffles 212 and the latching hole 211 cooperatively define two receiving holes 211*a* communicating via a central hole 211*b*. The inner barrel 20 includes four spaced outer teeth 24 uniformly arrange around the circumference of the outer surface 23. The outer teeth 24 are generally bent trapezoids projecting upwards from the second lower surface 22, with each including a first outer side 241, a second outer side 242, and an outer bevel 243. The first outer side 241 and the second outer side 242 are parallel to the central axis of the inner barrel 20, and the first outer side 241 is shorter than the second outer side 242. The outer bevel 243 interconnects the first outer side 241 and the second outer side 242 facing away from the second lower surface 22. The gradient of the outer bevel 243 is equal to the gradient of the inner bevel 143. The length of curve between the first outer side 241 and the second outer side 242 of one outer tooth 24 is slightly less than the length of curve between the first inner side 141 and the second inner side 142 of one inner tooth 15. The inner barrel 20 defines a first crown gear portion 221 in the second lower surface 22.

The spring 30 is a coil spring with relaxed length longer than the inner barrel 20. The outer diameter of the spring 30 is less than the inner diameter of the inner barrel 20.

The base 40 is a circular ring, and includes a working surface 41 and a side surface 42. The base 40 defines a second crown gear portion 411 in the working surface 41, and the second crown gear portion 411 mates with the first crown gear portion 221. The second crown gear portion 411 includes a number of first toothed surfaces 411*a* progressively rising around clockwise. The outer diameter of the base 40 is slightly less than the diameter of the inner diameter of the outer barrel 10. The base 40 extends four fixing blocks 421 corresponding to the four fixing grooves 16 outwards from the side surface 42.

The button 50 is a round plate, and includes top surface 51 and a bottom surface 52. A graphic 200 is mounted or defined on the top surface 51. The button 50 extends outward a latching part 53 generally from the center of the bottom surface 52. The latching part 53 includes two curved first plates 531 substantially perpendicular extend outward from the bottom surface 52 and two second plates 532 substantially perpendicular to the first plate 531. The radius of the first plate 531 is slightly less than that of the centre hole 211*b*. The second plates 532 correspond in shape to the receiving holes 211*a*.

During assembly, the inner barrel 20 is sleeved in the outer barrel 10 from the first lower surface 12. The guiding blocks 24 are respectively slidably latched in the guiding slot 15. The spring 30 is sleeved in the inner barrel 20. The four fixing blocks 421 respectively engage with the four fixing grooves 16, so that the base 40 encloses the first lower surface 42, and the working surface 41 faces the spring 30. As such, the spring 30 is biased between the baffles 212 and the working surface 42. The top of the first crown gear portion 221 is directly opposite to the first toothed surface 411*a* of the second crown gear portion 411. The first plates 531 and the second plates 532 of the latching part 53 are extruded into the inner barrel 20 from the central hole 211*b* and the receiving hole 211*a*, and rotate the button 50 about 90° to latch the second plates 532 by the baffles 212. Thus, the button 50 is fixed on the second upper surface 21 of the inner barrel 20.

Figure 4:
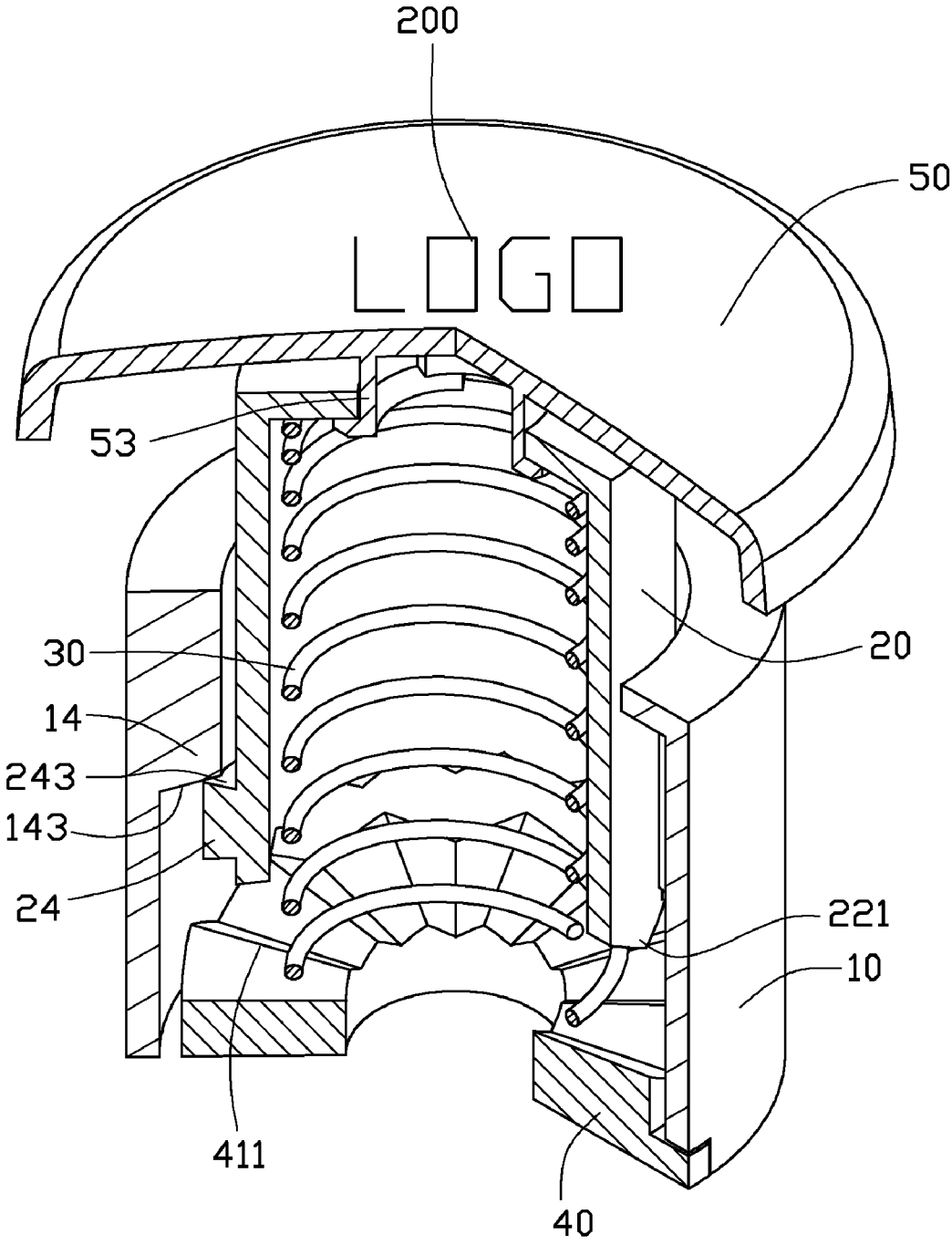
FIG. 4 is an assembled, cutaway view of the rotatable graphic assembly of FIG. 1.

Referring to FIG. 4, in use, when the button 50 is impelled toward the base 40, the outer teeth 24 slides out of the guiding slots 15, and the spring 30 is compressed. When the top of the first crown gear portion 221 contacts the first toothed surface 411*a*, the inner barrel 20 is forced to rotate counter-clockwise by a torque caused by relative movement between the first crown gear portion 221 and the second crown gear portion 411. When the button 50 is released, the inner barrel 20 is lifted from the base 40 by the restoring force of the spring 30. After the outer bevel 243 contacts with the inner bevel 143, the outer teeth 24 move along the inner bevel 143 of the inner teeth 14 by the restoring force of the spring 30. The outer teeth 24 slide into other guiding slots 15, and the inner barrel 20 rotates the graphic 200 of the button 50 about 90°.

It will be understood that the above particular embodiments and methods are shown and described by way of illustration only. The principles and the features of the present invention may be employed in various and numerous embodiment thereof without departing from the scope of the invention as claimed. The above-described embodiments illustrate the scope of the invention but do not restrict the scope of the invention.

What is claimed is:

1. A rotatable graphic assembly comprising:

an outer barrel comprising an inner surface and a plurality of inner teeth formed thereon with an inner bevel formed at an end of each inner tooth;

an inner barrel received within the outer barrel, the inner barrel comprising an outer surface and a plurality of outer teeth formed on the outer surface with an outer bevel formed at an end of each outer tooth and movably engaged with the inner teeth, the inner barrel defining a first crown gear portion at one end thereof;

a spring sleeved in the inner barrel;

a base sealing one end of the outer barrel, the spring biased between the other end of the outer barrel away from the base and the base; the base defining a second crown gear engaging with the first crown gear portion; and a button disposed on the end of the second barrel away from the base and showing a graphic thereupon;

wherein, when the button is impelled toward the base, the inner barrel is rotated by a torque caused by relative movement between the first crown gear portion and the second crown gear portion caused by the impel;

wherein, when the button is released, the inner barrel is restored and continues to be rotated by a torque caused by relative movement along the engaging inner bevel and outer bevel caused by a restoring force of the spring.

2. The rotatable graphic assembly in claim 1, wherein each of the inner teeth comprises a first inner side, a second inner side, and the inner bevel interconnecting the first inner side and the second inner side, wherein the first inner side is longer than the second inner side and the first inner side of one inner tooth faces the second side of an adjacent inner tooth, thereby forming a guiding slot therebetween.

3. The rotatable graphic assembly in claim 2, wherein each of the outer teeth is latched in the guiding slot and comprises a first outer side, a second outer side, and the outer bevel interconnecting the first outer side and the second outer side; wherein the first outer side is shorter than the second outer side.

4. The rotatable graphic assembly in claim 3, when the outer teeth latches the guiding blocks, the top of the first crown gear portion is directly opposite to a first toothed surface of the second crown gear portion, and the first tooth progressively rises around clockwise.

5. The rotatable graphic assembly in claim 3, wherein the gradient of the outer bevel is equal to the gradient of the inner bevel.

6. The rotatable graphic assembly in claim 1, wherein the relaxed length of the spring is longer than the inner barrel.

7. The rotatable graphic assembly in claim 1, wherein the outer barrel defines a plurality of fixing grooves on one end thereof, and the base comprises a side surface and the base extends outward from a plurality of fixing blocks corresponding to the fixing groove from the side surface.

8. The rotatable graphic assembly in claim 1, wherein the inner barrel comprises a second upper surface and defines a latching hole in the second upper surface, the button extends outward a latching part, the latching part is latched in the latching hole.

* * * * *